United States Patent [19]

Bally et al.

[11] Patent Number: 5,037,003

[45] Date of Patent: Aug. 6, 1991

[54] DILUTION STATION

[75] Inventors: Alexander Bally, Pittsburgh, Pa.; Allen E. Brandenburg, Austin, Tex.; Charles Kraeuter, Springdale, Pa.; James M. Rubenstein, San Antonio, Tex.; Doris M. Wong, Pittsburgh, Pa.

[73] Assignee: Scott Paper Company, Philadelphia, Pa.

[21] Appl. No.: 553,937

[22] Filed: Jul. 17, 1990

[51] Int. Cl.[5] ..... B67D 5/56

[52] U.S. Cl. ..... 222/129.2; 222/153; 239/340; 417/198

[58] Field of Search ..... 222/74, 75, 80, 81, 222/129.2, 133, 325, 630, DIG. 1, 153; 417/151, 198; 239/340

[56] References Cited

U.S. PATENT DOCUMENTS

| | | | |
|---|---|---|---|
| D. 297,968 | 10/1988 | Norman et al. | D23/200 |
| 650,166 | 5/1900 | Chadbourn | 222/135 |
| 1,668,897 | 5/1928 | Gilstrap et al. | 222/153 |
| 2,134,865 | 11/1938 | Essery | 221/68 |
| 2,569,257 | 9/1951 | Parker | 222/153 |
| 2,763,416 | 9/1956 | Wormser | 222/518 |
| 2,766,910 | 10/1956 | Bauerlein | 222/129.2 |
| 2,823,833 | 2/1958 | Bauerlein | 222/129.2 |
| 2,965,268 | 12/1960 | Bauerlein | 222/193 |
| 3,113,725 | 12/1963 | Packard et al. | 239/318 |
| 3,209,797 | 10/1965 | Marchetti | 141/362 |
| 3,267,964 | 8/1966 | Steinmetz | 137/624.13 |
| 3,285,474 | 11/1966 | Gran | 222/183 |
| 3,552,568 | 1/1971 | Wade | 210/169 |
| 3,750,908 | 8/1973 | Baverlein et al. | 222/325 |
| 3,756,473 | 9/1973 | Donahue, Jr. | 222/129.2 |
| 3,976,228 | 8/1976 | Robbins | 222/143 |
| 4,098,431 | 7/1978 | Palmer et al. | 222/39 |
| 4,134,522 | 1/1979 | Patzke et al. | 222/153 |
| 4,193,520 | 3/1980 | Duffield | 222/630 |
| 4,218,013 | 8/1980 | Davison | 239/74 |
| 4,264,019 | 4/1981 | Roberts et al. | 222/325 |
| 4,291,821 | 9/1981 | Nezworski | 222/153 |
| 4,356,937 | 11/1982 | Simon et al. | 222/129.2 |
| 4,508,272 | 4/1985 | Thompson | 222/630 |
| 4,595,127 | 6/1986 | Stoody | 222/340 |
| 4,679,707 | 7/1987 | Sedam | 222/325 |

*Primary Examiner*—Michael S. Huppert
*Assistant Examiner*—Kenneth Bomberg
*Attorney, Agent, or Firm*—Mark G. Bocchetti; John W. Kane, Jr.

[57] ABSTRACT

Disclosed is an apparatus for diluting and dispensing fluid concentrates which comprises a frame having a least one compartment therein for insertion of a liquid holding container. Mounted within the frame is a water valve housing which is adapted to interface with a venturi housing affixed to the liquid holding container. The water valve housing has affixed thereto a solenoid valve which is manually actuated by moving a magnet into and out of close proximity with the stem of the solenoid valve. The water valve housing includes locking means for preventing the solenoid valve from being operated by the manual actuation means when the liquid holding container is not properly inserted into the dilution station.

The refill modules of the present invention include the venturi housing and liquid holding container mentioned above. The venturi housing has an unlocking means extending therefrom which engages and unlocks the locking means of the water valve housing when the refill is properly installed in the dilution station. Insertion of the refill makes a sealed connection to the water valve, vents the refill, locks the refill into position and releases the operation of the manual valve actuation. The discharge tube is "D" shaped to prevent spraying solution on to the operator in the event of over filling the bottle.

18 Claims, 15 Drawing Sheets

FIGURE 21
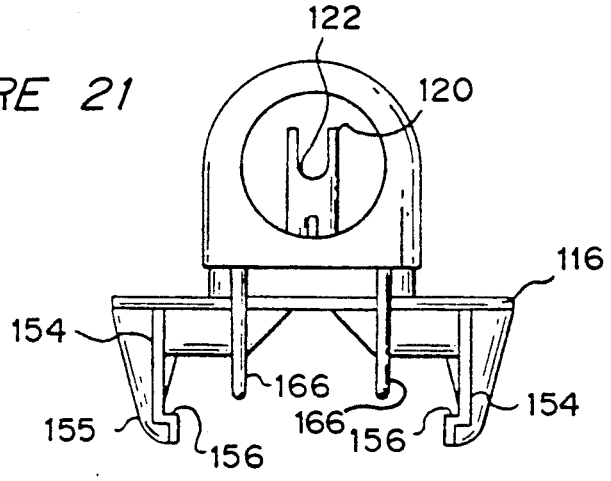
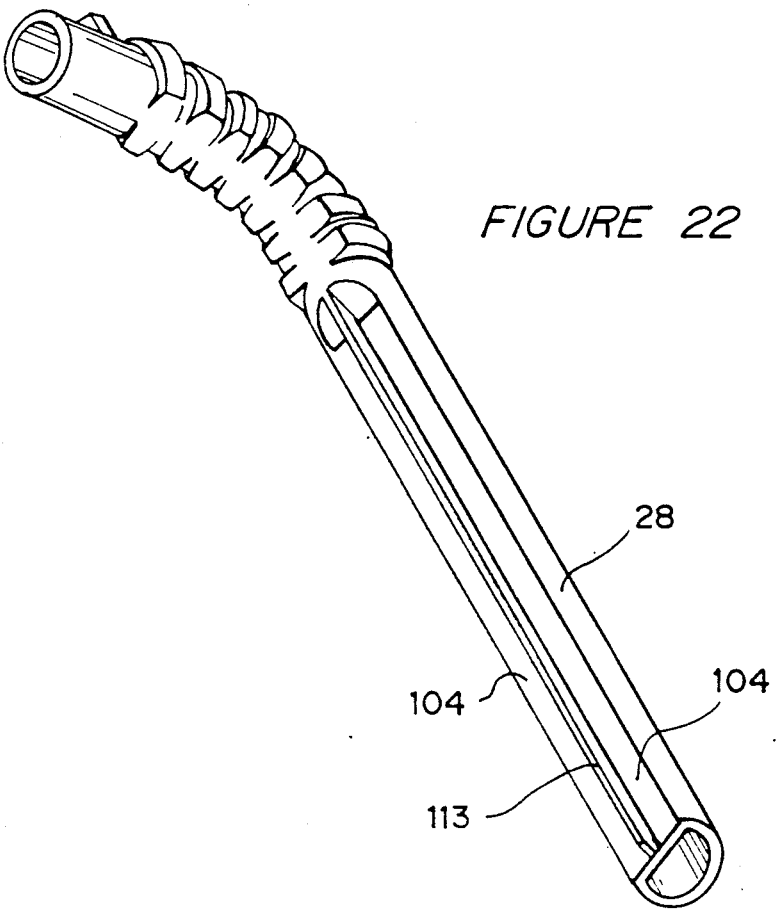
FIGURE 22

DILUTION STATION

BACKGROUND OF THE INVENTION

1. Field of the Invention

This invention relates generally to apparatus for diluting and dispensing fluid concentrates and, more particularly, to apparatus for diluting and dispensing one or more liquid cleaning concentrates.

2 Brief Description of the Prior Art

Various liquid and diluting and dispensing systems are known in the prior art. One such dispenser is taught in U.S. Pat. No. 2,766,910 to Bauerlein. Bauerlein teaches a dispenser for dispensing drinks such as juices and colas wherein the concentrate is contained within a can and a dispensing tube is inserted into that can. The dispensing tube is connected to a venturi. The pressure drop through the venturi draws the concentrate from the can and dilutes it as it is dispensed.

U.S. Pat. No. 4,679,707 to Sedam teaches another beverage dispenser which dilutes and dispenses beverage concentrates from syrup containers. Such apparatus uses plug-in syrup containers and $CO_2$ cylinders.

Yet another carbonated beverage dispenser is taught in U.S. Pat. No. 4,264,019 to Roberts, et al. Roberts teaches the use of a collapsible bag containing a carbonated beverage. The collapsible bag is contained within a cartridge-tube. As the beverage is dispensed, water under pressure enters the cartridge-tube causing the bag to collapse on itself preventing the carbonated beverage from de-gassing.

U.S. Pat. No. 2,763,416 to Wormser teaches an apparatus for filling a bank of containers simultaneously from the bottom. A liquid header is used to supply a fill tube for each can to be filled.

U.S. Pat. No. 4,098,431 to Palmer, et al. teaches a chemical replenisher system for supplying developer and fixer chemicals to a processor. The apparatus is designed to be used with containers of chemicals. Water is introduced to an electric solenoid control valve.

Nothing in the prior art teaches a modularized dilution station for diluting one or more concentrates which includes a locking means for preventing the actuation of the water supply valve when the container of concentrate is not properly and fully installed into the dispensing apparatus. Further, nothing in the prior art teaches a manual actuating means for opening a water supply valve and simultaneously drawing concentrate through a venturi wherein the actuating means may be manually displaced while the valve remains inoperable if the disposable container of concentrate is not fully inserted into the dispenser. Further, nothing in the prior art teaches a disposable container for holding concentrates wherein the container has affixed thereto a disposable venturi and dip tube. In such manner, it is assured that the venturi size is correct for the chemical contained within the disposable container. Further, because the disposable container includes the venturi when the concentrate is fully depleted therefrom, the typical long-term maintenance problems of utilizing a venturi which is intended to be a permanent installation are obviated. Such long-term problems include scaling, clogging, erosion and corrosion.

SUMMARY OF THE INVENTION

It is therefore an object of the present invention to provide a modularized dilution station for diluting and dispensing one or more concentrated fluids which includes a means for preventing the actuation of the water supply valve when the concentrate container is not properly interfaced with the water supply line.

It is another object of the present invention to provide a disposable container for use with a dilution station for diluting and dispensing concentrated chemicals contained within such disposable container wherein the disposable container includes a venturi sized specifically for the concentrate being diluted and dispensed and wherein said venturi is disposable along with said container.

The further object of the present invention is to provide a manually actuable valve means for diluting and dispensing fluid concentrates wherein there is incorporated safety means for preventing actuation when the venturi is not properly joined to the water supply line.

Still another object of the present invention is to provide a piston for operating a valve allowing water to flow through a venturi wherein said piston may be manually displaced but will fail to actuate the water supply valve if the venturi is not properly interfaced with the water supply line.

It is still another object of the present invention to provide a disposable refill cartridge for holding concentrates which includes a dispensing tube which is substantially cylindrical but for a flat surface opposite the operator providing a vent opening between the dispensing tube and the bottle being filled so that any overfilling of a bottle will result in the overflow being directed away from the operator.

Briefly stated the foregoing and numerous other objects, features and advantages of the present invention will become readily apparent upon reading of the detailed description, claims and drawings set forth herein. These objects, features and advantages are accomplished through the use of a modularized dispensing cabinet having compartments therein for receipt of containers of concentrated fluids. The containers are disposable and have affixed thereto a venturi which is adapted to engage to a water supply line. The modularized dispenser is manifolded such that a water supply line is provided for each compartment. The dispenser includes manually actuated piston means for actuating the water supply valve for each compartment. Safety means are provided such that if the venturi mounted to a container is not properly interfaced with the water supply line in a particular compartment, the water supply valve cannot be opened by operation of the manually operated piston means.

The water supply valve is a solenoid type valve and it is opened by bringing ceramic magnets in close proximity to the valve to cause it open. The present invention further includes means for preventing the magnets from moving in close proximity to the solenoid valve if the venturi arrangement has not been properly interfaced with the water supply line. This safety mechanism does not prevent the manual operation of the piston means. Rather, it prevents the piston means from imparting movement of the magnets toward the solenoid. In such manner, there will be no opportunity or temptation for the operator to try the force of the piston inward to operate the valve. The piston will freely move inward and because the valve does not operate, the operator will know that he has not properly installed the container of concentrate.

The disposable container of the present invention has attached thereto the venturi arrangement which is also disposable. Because the venturi is part of the disposable container venturi sizing is properly set for the specific chemical stored in each container. There can be no operator mixup as with other systems wherein the chemical concentrate is diluted using the wrong diameter venturi orifice. Further, because the venturi is disposable, and not intended for long term use, it can be manufactured from inexpensive materials without the need to worry about corrosion, erosion, cleaning and maintenance.

BRIEF DESCRIPTION OF THE DRAWINGS

FIG. 21 is an end view of water valve housing.

FIG. 22 is a perspective view of the dispensing tube.

DETAILED DESCRIPTION OF THE PREFERRED EMBODIMENT

Figure 2:
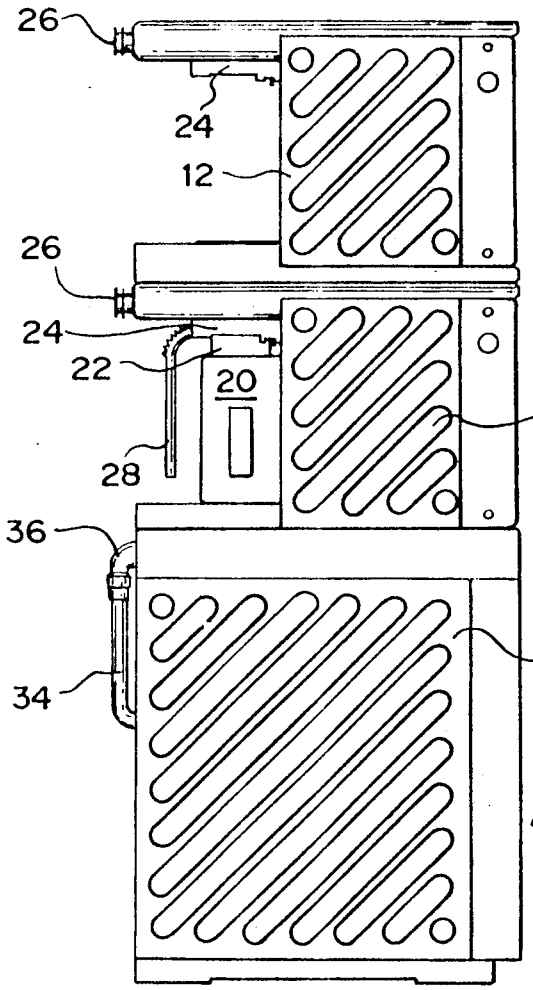
FIG. 2 is a side elevation of the dilution station of the present invention.
Figure 1:
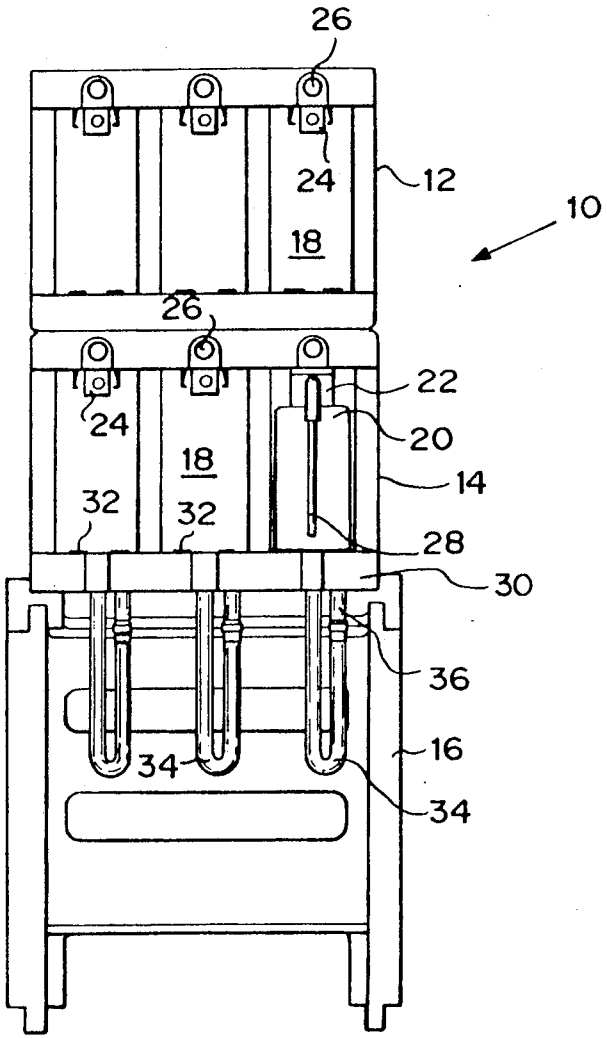
FIG. 1 is a front elevation of the dilution station of the present invention.
Figure 18:
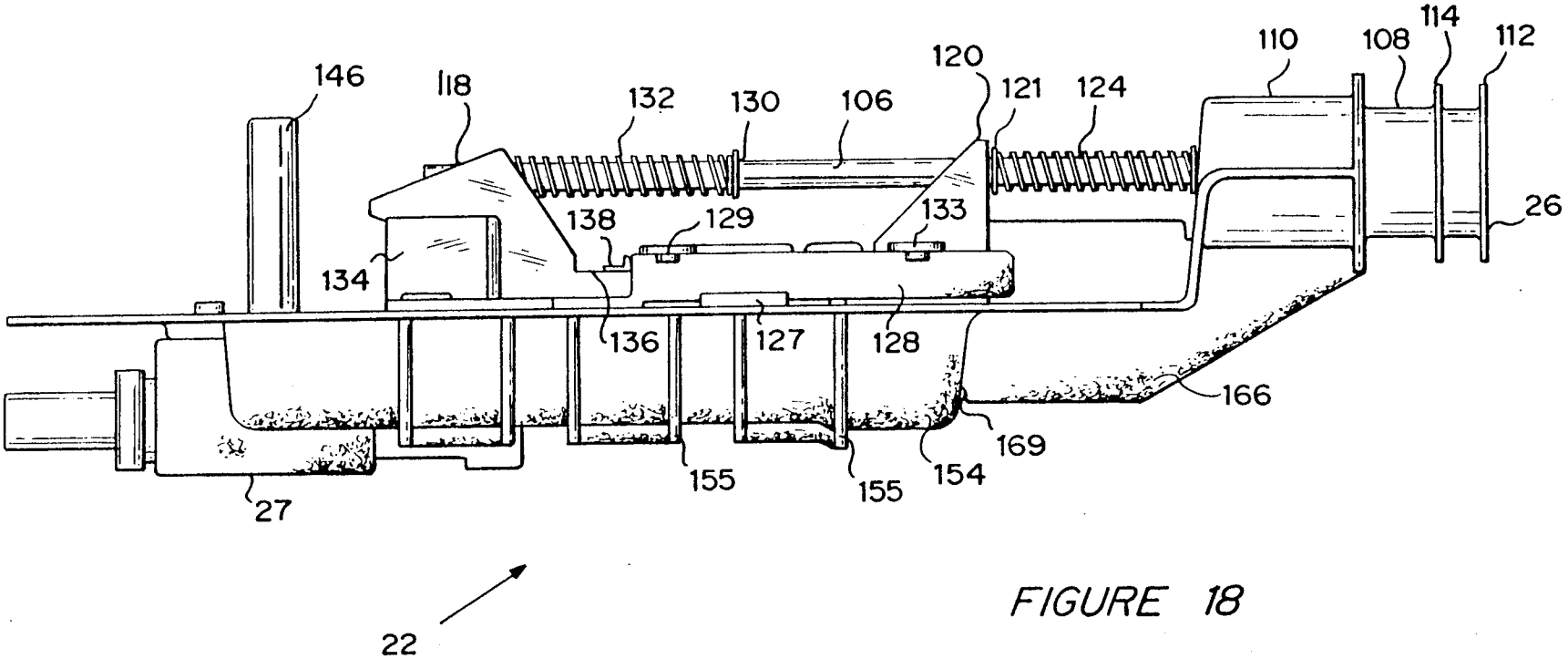
FIG. 18 is a side elevation of the water supply valve assembly.

Turning first to FIG. 1 there is shown a modular dilution station apparatus 10 of the present invention. As depicted, there is a bottle filling unit or frame 12 which is stacked upon a combination bottle/bucket filling unit or frame 14. Both the bottle filling unit 12 and the combination bottle/bucket filling unit are supported on stand 16. The bottle filling unit 12 and the combination bottle/bucket filling unit 14 each include a plurality of compartments or openings 18 adapted to receive refill modules 20. Each refill module 20 is adapted to hold a quantity of a concentrated chemical to dilute upon dispensing. At the top of each refill module 20 is a venturi housing 22 which is adapted to engage and interface with water supply valve housing 24. There is a water supply valve housing 24 mounted within each receptacle 18. Each water supply valve housing 24 is manifolded to a single water supply header. Located above each compartment 18 is a push button actuator 26 for manually actuating water supply or delivery valves 27 (see FIG. 18).

Each modular refill 20 includes a dispensing tube 28 which may be inserted into a bottle for filling of the bottle. The combination bottle/bucket filling unit 14 differs from the bottle filling unit 12 in that the base 30 of the combination bottle/bucket filling unit 14 includes a funnelled recess 32 for each compartment 18. Each funnelled recess 32 is slidably or telescopically engaged with base 30 such that it can be slid upward to couple with dispensing tube 28 in a male/female arrangement. Extending from each funnelled recess 32 is hose 34 which can be used for filling buckets supported on the floor. The dispensing or distal ends 36 of hoses 34 are supported by brackets extending from base 30 so that hoses 34 are not left to lay on the floor and further to prevent any residual chemicals which may be left in hoses 34 after use from draining onto the floor.

Figure 3:
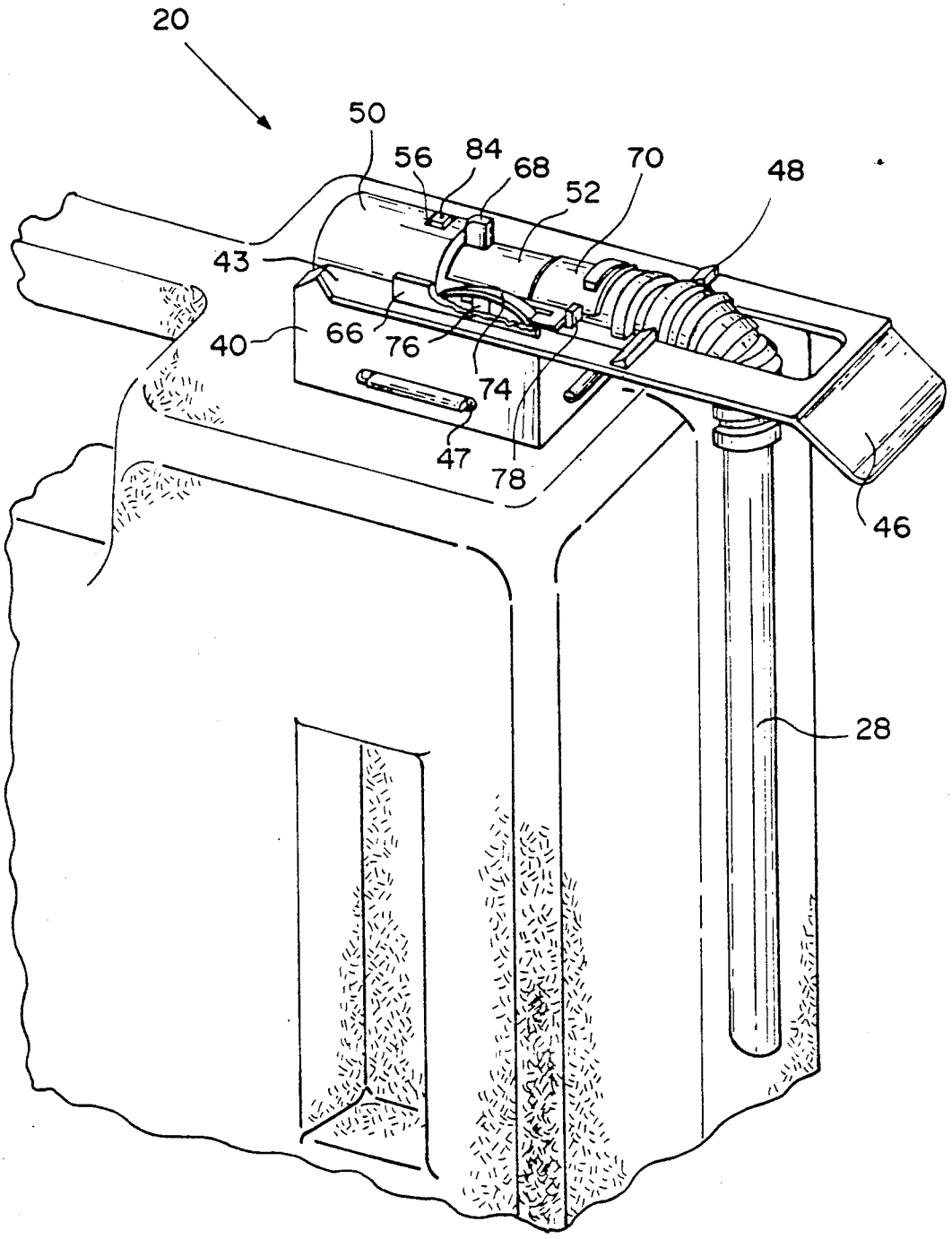
FIG. 3 is a perspective view of a modular refill of the present invention.
Figure 4:
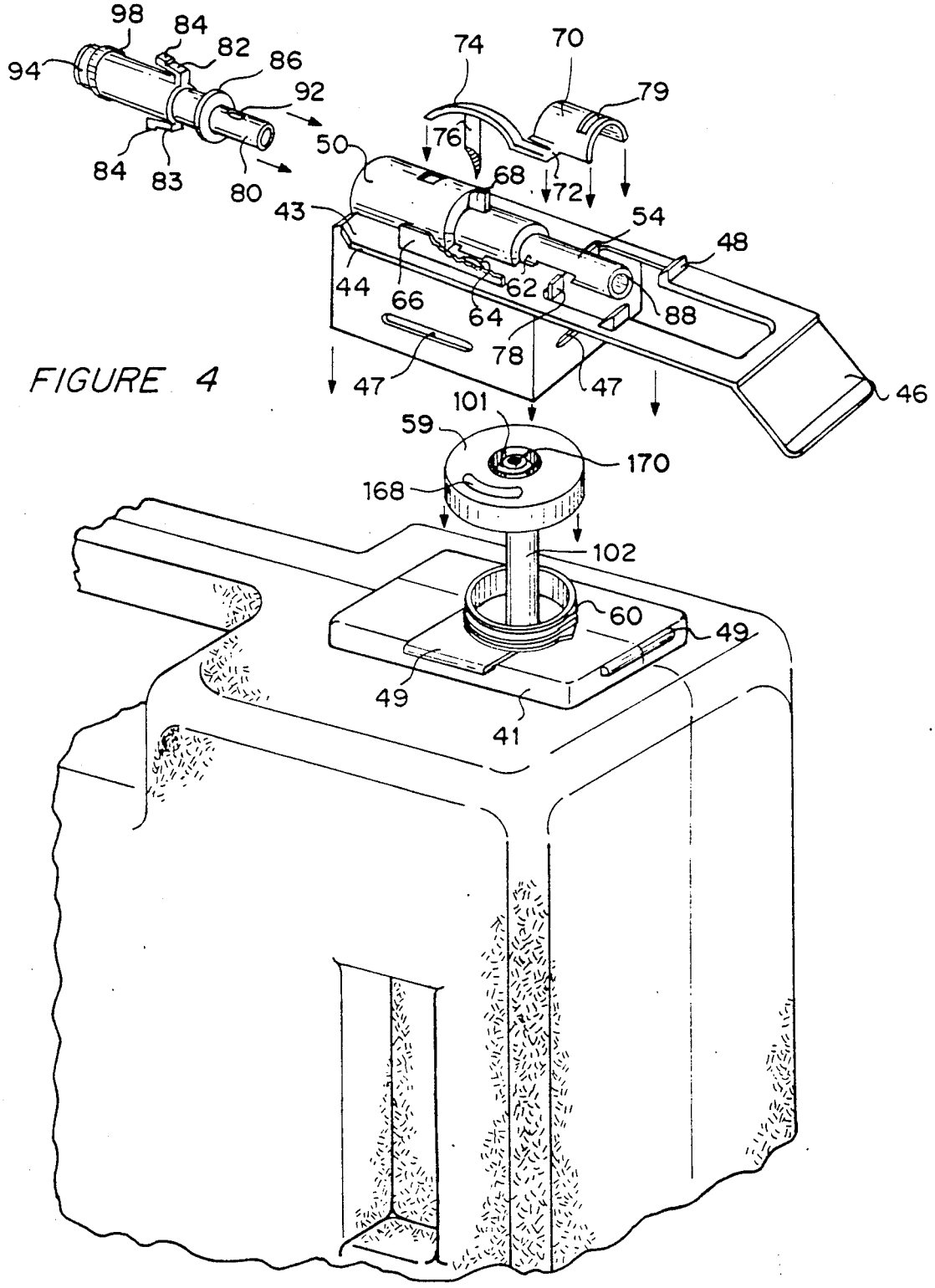
FIG. 4 is an exploded perspective of a modular refill.
Figure 5:
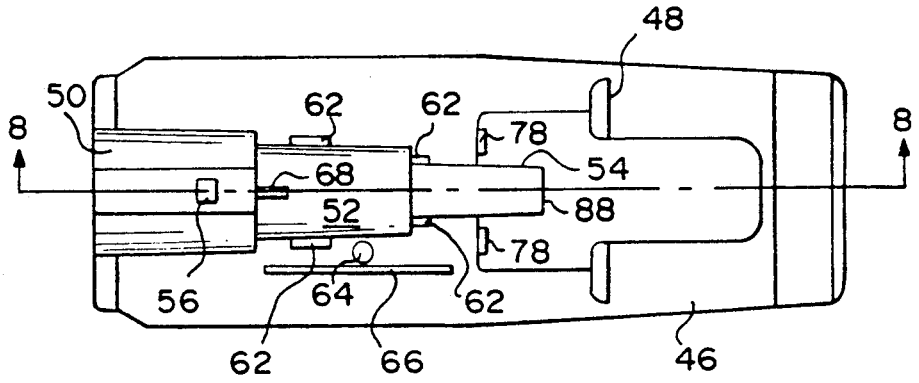
FIG. 5 is a top plan view of the venturi housing.
Figure 6:
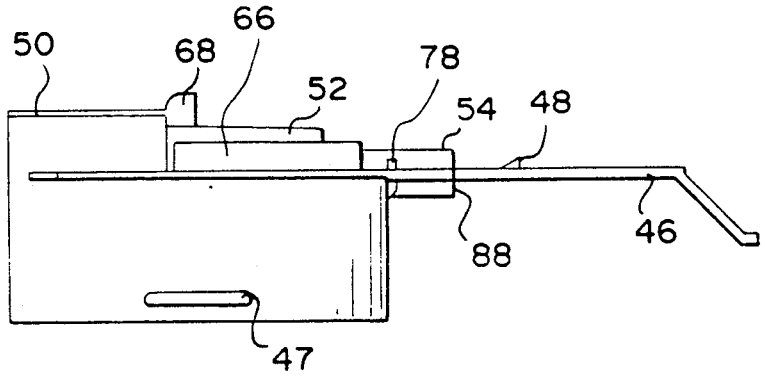
FIG. 6 is a side elevation of the venturi housing.
Figure 7:
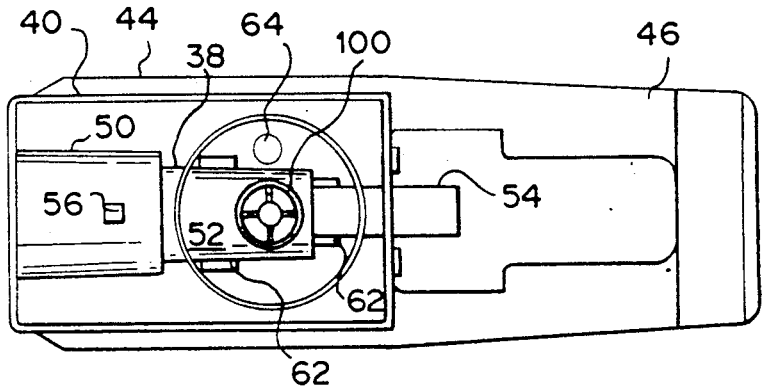
FIG. 7 is a bottom plan view of the venturi housing.
Figure 8:
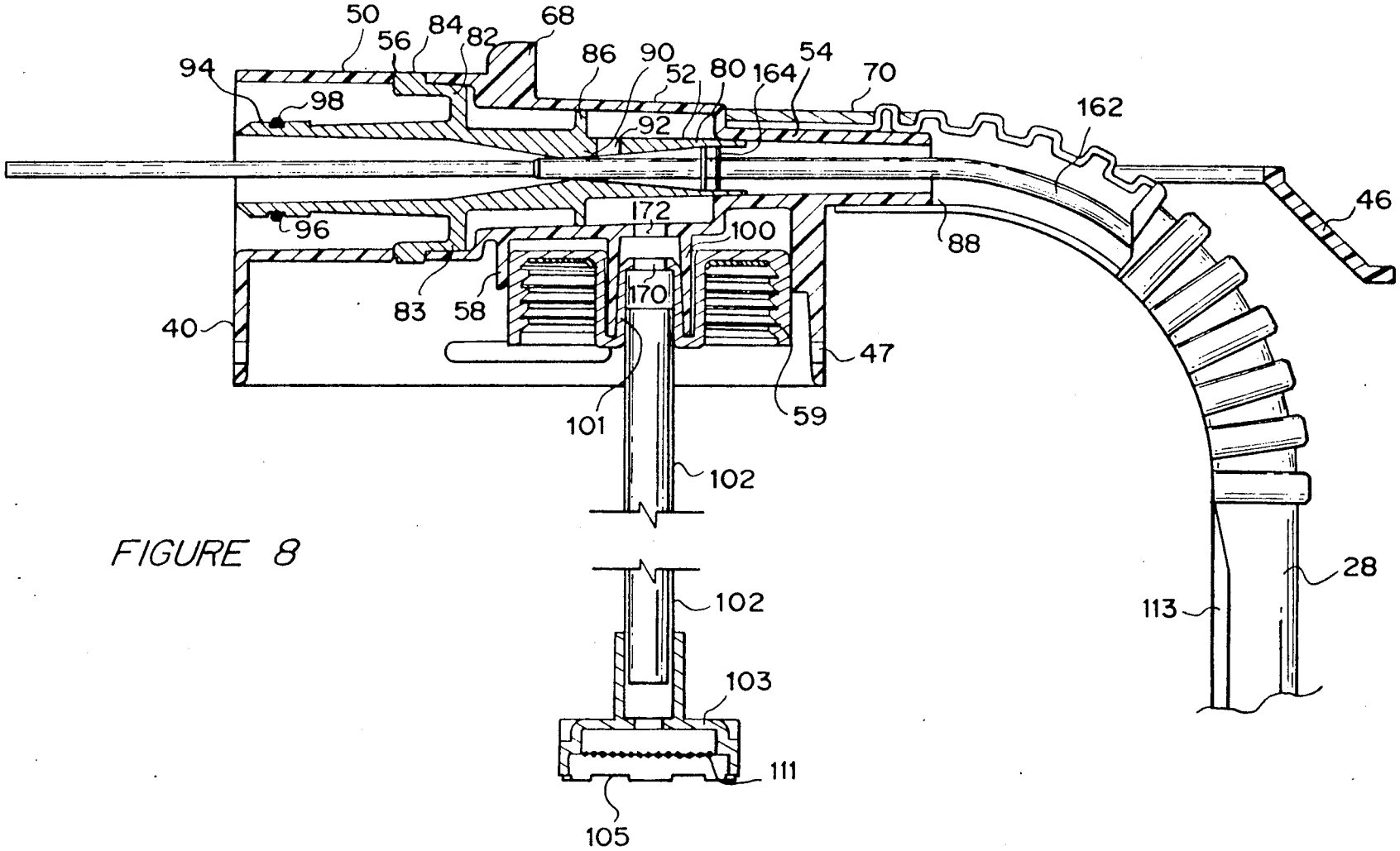
FIG. 8 is a cross sectional view of the venturi housing taken along line 8—8 of FIG. 5.
Figure 10:
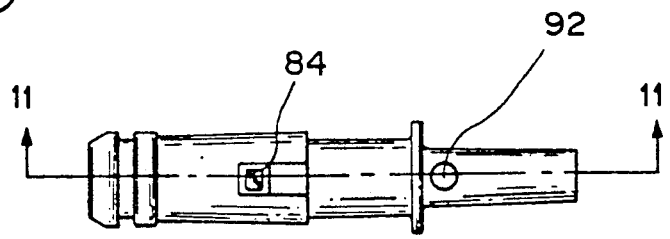
FIG. 10 is a side elevation of the venturi tube axially rotated 90° from the view shown in FIG. 9.
Figure 9:
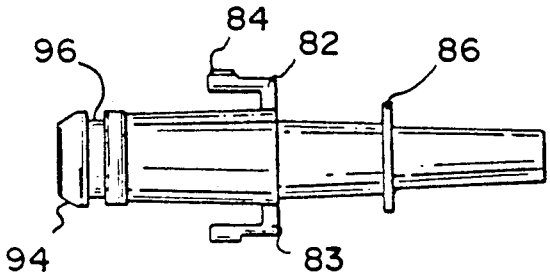
FIG. 9 is a side elevation of the venturi tube.
Figure 11:
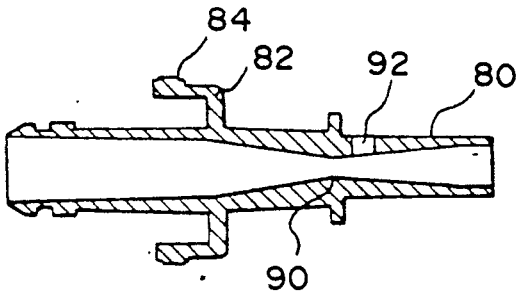
FIG. 11 is a cross section of the venturi tube taken along line 11—11 of FIG. 10.
Figure 12:
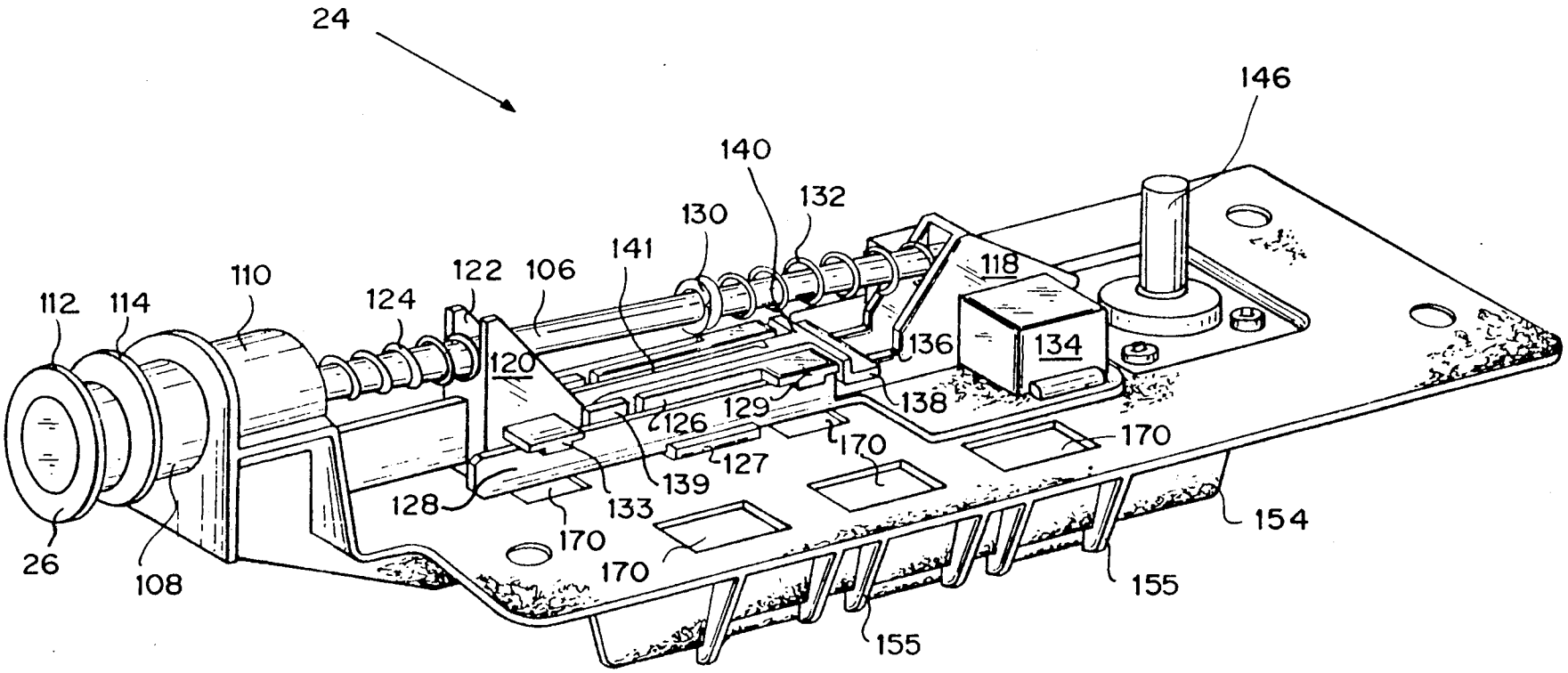
FIG. 12 is a perspective view of water supply valve assembly of the present invention in an unactuated position.
Figure 13:
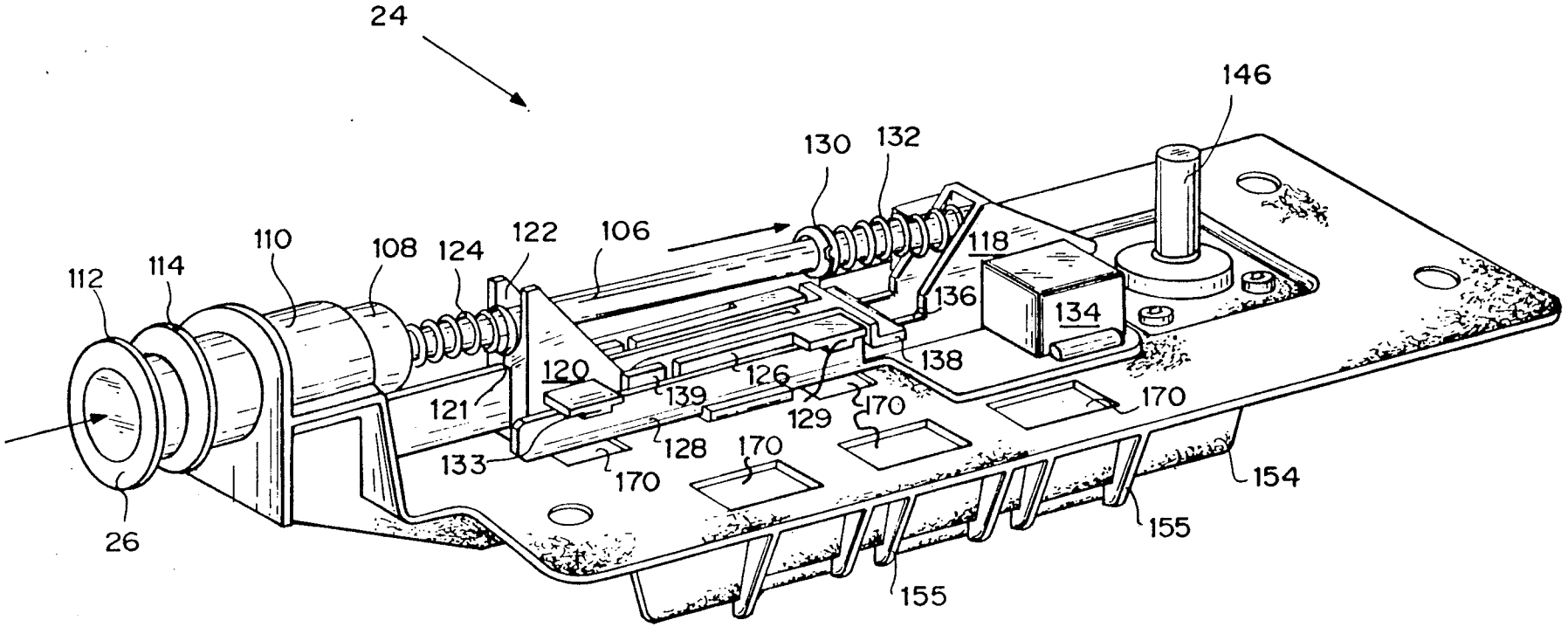
FIG. 13 is a perspective view of the water supply valve assembly of the present invention with the push button actuator displaced and the valve remaining unactuated.
Figure 14:
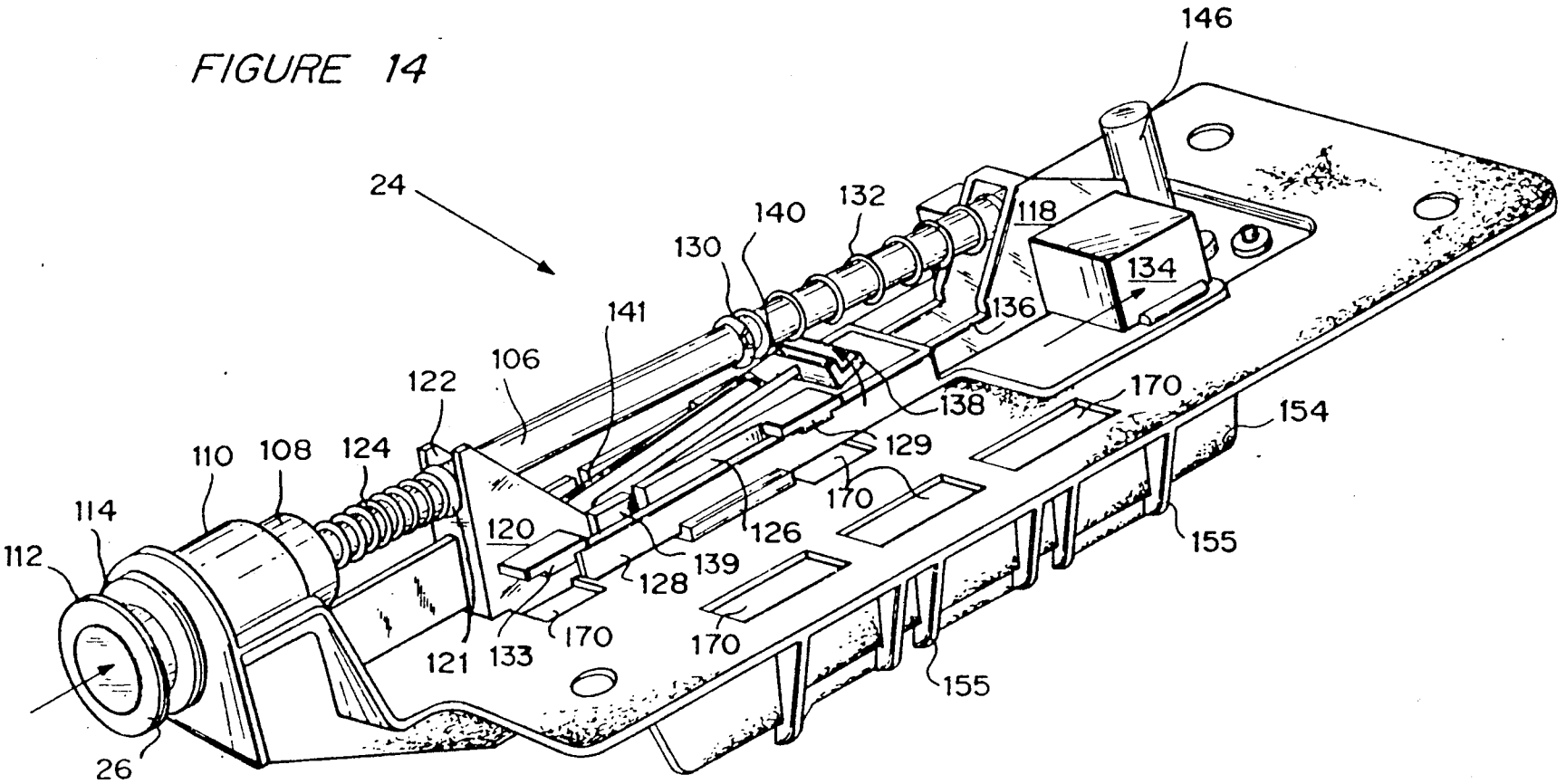
FIG. 14 is a perspective view of the water supply valve assembly of the present invention with the push button actuator displaced and the valve actuated.
Figures 15, 15A:
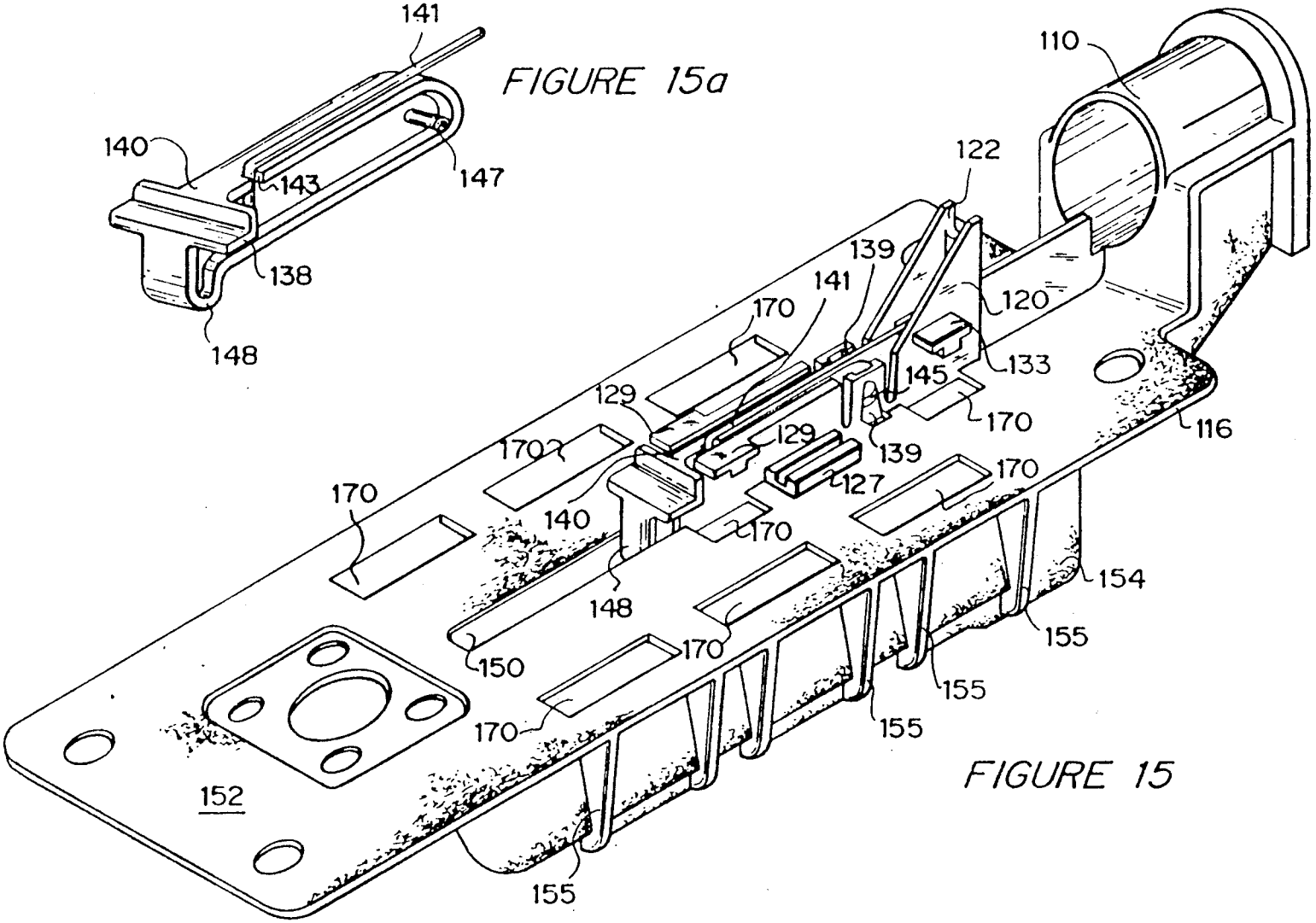
FIG. 15 is a perspective view of the water supply valve assembly with the valve, magnet, magnet carrier, skids and rod removed therefrom.
FIG. 15*a* is a perspective view of the pivot bar, locking bar and pivot bar spring.
Figure 16:
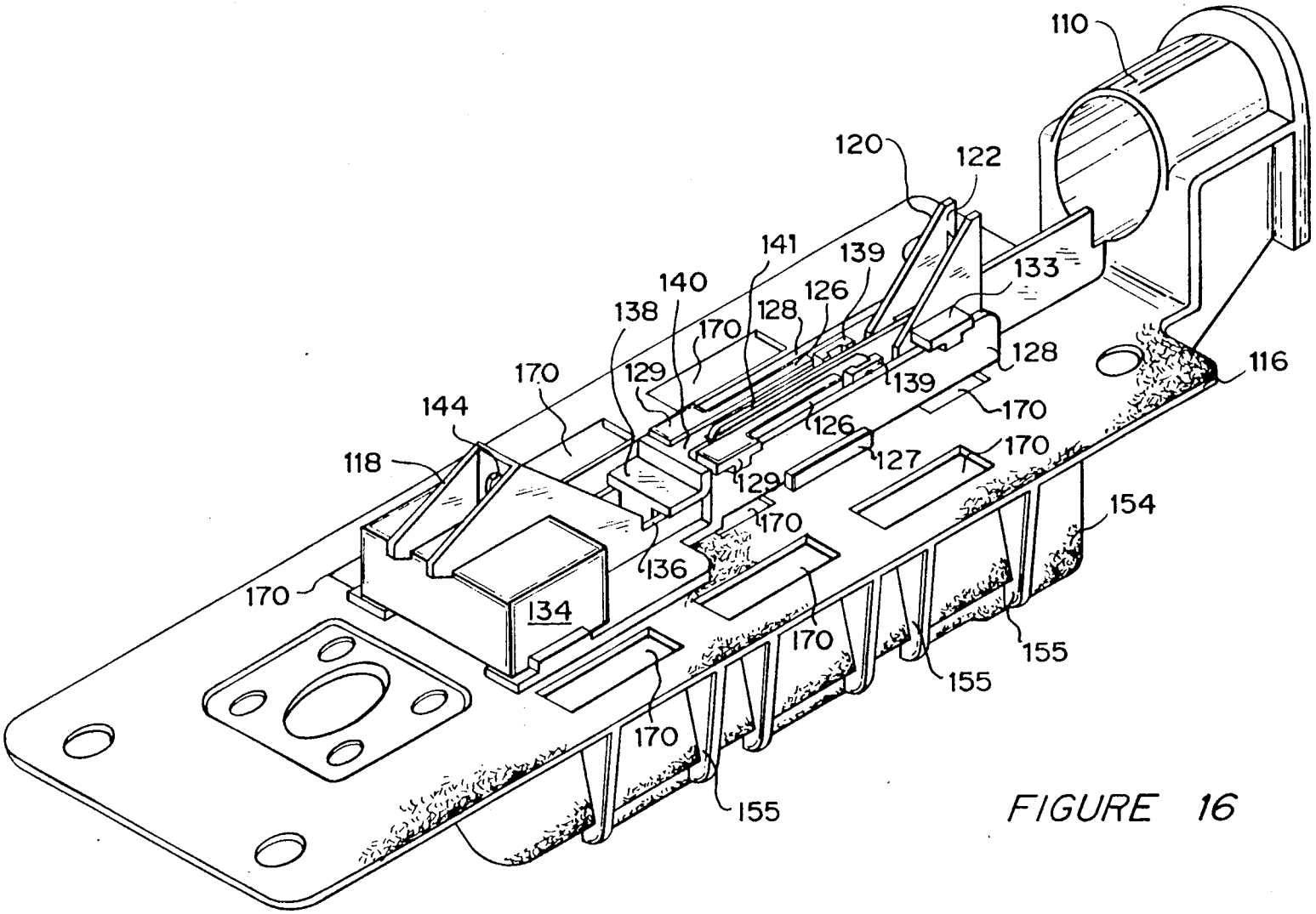
FIG. 16 is a perspective view of water supply valve assembly with the valve and rod removed therefrom.
Figure 17:
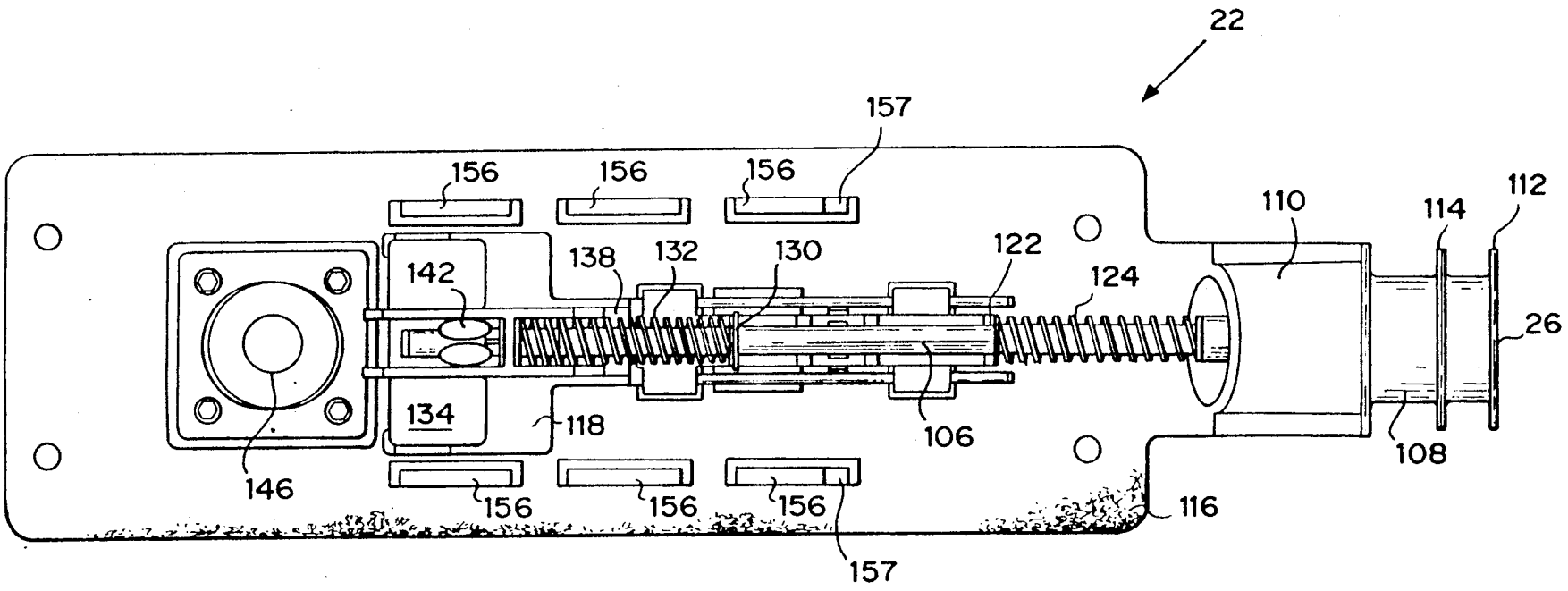
FIG. 17 is a top plan view of the water supply valve assembly.

Shown more clearly in FIGS. 3 and 4 is modular refill 20 having venturi housing 22 exploded therefrom. Venturi housing 22 shown in detail in FIGS. 3 through 7 includes mounting bracket 40 formed integrally therewith. Venturi housing 22 is affixed to container 42 by means of mounting bracket 40 which is rectangular in cross section and fits over a rectangular projection 41 extending up from container 42. Mounting bracket 40 includes slots 47 which engage ribs 49 protruding from rectangular projection 41. Venturi housing 22 also includes plate 43 at the top of mounting bracket 40. Coplanar with plate 43 are flanges or wing sections 44 which extend beyond the sides of mounting bracket 40. Flanges 44 extend forward of venturi housing 22 to form handle 46. Extending up from handle 46 are ramps 48.

The rear of venturi housing 22 includes inlet nozzle section 50. Inlet nozzle 50 is cylindrical and is integrally formed with venturi shell 52. Venturi shell 52 is substantially cylindrical with a slight taper. Extending forward of venturi shell 52 is outlet or discharge nozzle 54 which is also cylindrical with a slight taper. The cylindrical axes of inlet nozzle 50, venturi shell 52 and outlet nozzle 54 are substantially colinear. Inlet nozzle 50 includes two rectangular ports 56 therethrough. Extending downward from plate 43 is circular bracket 58 which is adapted to mate with threaded cap 59. Cap 59 is threadably engaged with spout 60 at the top of container 42.

Plate 43 has a plurality of openings or slots 62 therein where plate 43 meets venturi shell 52 and outlet nozzle 54. The purpose of openings or slots 62 is to prevent venturi shell 52 from being pulled out of round by shrinkage of plate 43 which may occur immediately after manufacture. There is also a vent probe opening 64 through plate 43.

Extending substantially vertically upward from plate 43 is guide bar 66. Guide bar 66 is substantially rectangular and is shown partially cut away in FIGS. 3 and 4 to expose vent probe 76 and vent probe opening 64. Extending upward from venturi shell 52 is unlocking means or key 68. Mounted over outlet nozzle 54 is vent probe support 70. Vent probe support 70 is substantially semi-cylindrical in configuration and has side brackets 72 extending therefrom. Projecting rearward from one of side brackets 72 is flex member 74. Flex member 74 is arcuate and resides between guide bar 66 and venturi shell 56. Extending downward from flex member 74 is vent probe 76. When vent probe support 70 is mounted over outlet or discharge nozzle 54, side brackets 72 reside between venturi shell 52 and ridges 78 with vent probe 76 extending down through vent probe opening 64. Vent probe support 70 also includes slot 79.

Residing within venturi housing 22 is venturi tube 80. Venturi tube 80 has extending therefrom struts 82 and 83 which are substantially L-shaped. At the distal end of each of struts 82 and 83 there is a protuberance 84. As venturi tube 80 is inserted into venturi housing 38, struts 82 flex inwardly due to contact with the internal surface of inlet nozzle 50. When protuberances 84 are aligned with rectangular ports 56, struts 82 and 83 spring outwardly causing protuberances 84 to move into and engage rectangular ports 56 thereby fixing the location of venturi tube 80. When venturi tube 80 is fully inserted, annular extension 86 sealingly engages the internal surface of venturi shell 52. Simultaneously, the discharge or outlet end 88 of venturi tube 80, which is slightly tapered, sealingly engages the internal surface of outlet or discharge nozzle 54. Preferably, the degree of taper of the internal surface of outlet nozzle 54 differs from the degree of taper of the discharge end 88 of venturi tube 80. This difference in degree of taper will promote a wedged coupling of venturi tube 80 to outlet nozzle 54 enhancing the sealed relationship without the need for gaskets.

Venturi tube 80 includes a restriction throat 90 across which a pressure drop is generated during operation. Downstream of the restriction throat 90 is orifice 92. During operation, the pressure drop taken across restriction throat 90 causes the chemical concentrate in container 42 to be drawn through orifice 92. Orifice 92 must therefore be sized for the specific chemical concentrate being diluted to ensure that the water/chemical mixing ratio is correct.

The inlet end 94 of the venturi tube 80 includes an annular recess of 96 which provides a residence for an 0-ring 98. When a refill module 20 is fully inserted into a compartment 18, the water supply nipple extending from water supply valve 27 will have been inserted into inlet nozzle 50 and about inlet end 94 with 0-ring 98 providing a seal for the male/female coupling of the water supply nipple to inlet end 94.

The use of struts 82 to affix venturi tube 80 within venturi housing 22 provides a significant advantage. Venturi housings 22 will be identical regardless of what concentrate is contained in refill module 20. Only the proper venturi tube 80 need be selected and the only difference between venturi tubes 80 is the size of orifice 92.

Struts 82 and 83 are unequal in size so that venturi tube 80 can be installed in only one orientation. The protuberance 84 of strut 82 which fits under the rectangular port 56 at the top of housing 22 is coded during manufacture to identify the diameter of that particular orifice 92. The code on protuberance 84 allows inspection of the assembled refill to assure the proper orifice 92 and, hence, the proper dilution of the cleaning concentrate.

Extending downward from venturi shell 52 is cylindrical skirt 100 which sealingly engages draw tube nozzle 101 integrally formed with threaded cap 59. Press-fit into draw tube nozzle 101 and extending downward therefrom into container 42 is draw tube 102. Mounted to the base of draw tube 102 is foot 103 which is intended to rest on the bottom wall of container 42. Foot 103 includes a series of indentations 105 in the bottom edge thereof such that chemical concentrate can flow through indentations 105. Mounted within foot 103 is filter screen 111 to ensure that any particulates which may accidentally be held within contain 42 cannot flow through draw tube 102 and potentially foul orifice 92.

Mounted to outlet nozzle 54 is dispensing tube 28. Dispensing tube 28 includes a ribbed portion for added strength and flexibility. As best seen in FIG. 22, the cross section of dispensing tube 28 is substantially circular with a flat surface 104 on one side thereof which extends for substantially the length of dispensing tube 28. A portion of dispensing tube 28 may be sandwiched between outlet nozzle 54 and vent probe support 70 to aid in the retention of dispensing tube 28 on outlet nozzle 54. Also to aid retention of dispensing tube 28 on outlet nozzle 54, one of the ribs of dispensing tube 28 may project through slot 79.

Dispensing tube 28 includes a flat surface 104 which is located on that side of the dispensing tube 28 nearest container 52 and furthest away from a person operating the dilution station 10. Flat surface 104 is an important safety feature and preferably includes spine 113 projecting perpendicularly therefrom. When an operator inserts dispensing tube 28 into a bottle for filling, the flat surface 104 ensures that there will be a vent gap between the flat surface 104 and the neck of the bottle being filled. Further, because the flat surface 104 is located on the side of the dispensing tube away from the operator, should the operator overfill a bottle, back splash and overflow will be directed back toward the dilution station 10 and away from the operator. Spine 113 insures that when dispensing tube 28 is inserted into a bottle, flat surface 104 is separated from the neck of the bottle maintaining the vent gap away from the operator.

Looking next at FIGS. 12 through 18 there is shown in detail the water supply valve assembly 24 of the present invention. Water supply valve assembly 24 includes push button actuator 26 which has connected thereto rod 106. Push button actuator 26 includes a piston 108 formed integrally therewith which resides in cylinder 110. Push button actuator 26 also includes an annular lip 112 at the distal end thereof. There is a travel stop lip 114 radially extending from piston 108. Travel stop lip 114 serves as a travel stop preventing push button 26 from being fully inserted into cylinder 110. Annular lip 112 serves as a means for pulling out push button 26 should it become jammed for any reason in cylinder 110.

Cylinder 110 is formed integrally with frame 116. The distal end of rod 106 extends to and through magnet bracket 118 which is slidably supported upon valve frame or housing 116. Extending upward from valve frame or housing 116 intermediate to magnet bracket 118 and cylinder 110 is retainer 120. Retainer 120 includes a U-shaped slot 122 at the top thereof through which rod 106 extends. Residing about rod 106 and located between cylinder 110 and retainer 120 is spring 124. A washer 121 is provided on rod 106 adjacent retainer 120. Rearward of retainer 120 are guide rail supports 126 which extend upward from frame 116 and are substantially parallel to rod 106. Extending from magnet bracket 118 and formed integrally therewith are skids 128. Formed integrally with frame 116 and guide rail supports 126 are lower guide rails or tracks 127 which are substantially U-shaped in cross section. Extending from legs 126 are a first pair of upper guide rails 129 and extending from retainer 120 are a second pair of upper guide rails 133. Skids 128 slide horizontally in tracks 127 and upper guide rails 129 and 133.

There is a washer 130 retained at a position on rod 106 by snap ring 131 and a spring 132. Spring 132 resides about rod 106 between washer 130 and magnet bracket 118. Affixed to magnet bracket 118 is magnet 134.

Skids 128 have notches 136 therein. Locking bar 138 resides in and across notches 136. Locking bar 138 is affixed to pivot bar 140 which is pivotally connected to ears 139 extending up from frame 116. Ears 139 include journals 145 in which pin 147 resides. There is a spring 141 residing across the top of pivot bar 140 and extending down through a slot 143 and into a bore in pivot bar 140. Spring 141 urges pivot bar 140 and locking bar 138 downward such that locking bar is forced into notches 136.

The distal end of rod 106 includes a widened section 142 which has a radius larger than the radius of bore 144 in magnet bracket 118. A pin through or a cap on rod 106 or other spring retaining means may be substituted for widened section 142. Forward of magnet bracket 118 there is affixed to housing or frame 116 water supply valve 27 which is a solenoid valve with stem 146 extending vertically therefrom. Note that the coil has been removed from stem 146 and solenoid valve 27 is open and closed by moving magnet 134 into and out of close proximity with stem 146. In such manner, solenoid valve 27 is operated without connection to an external electrical power source. Extending down from pivot bar 140 is lever 148 which extends into slot 150 in frame 116. When an upward force is directed onto lever 148, pivot bar 140 will rotate upward lifting locking bar 148 from notches 136 thereby allowing lateral movement of skids 128 and magnet bracket 118.

Figure 19:
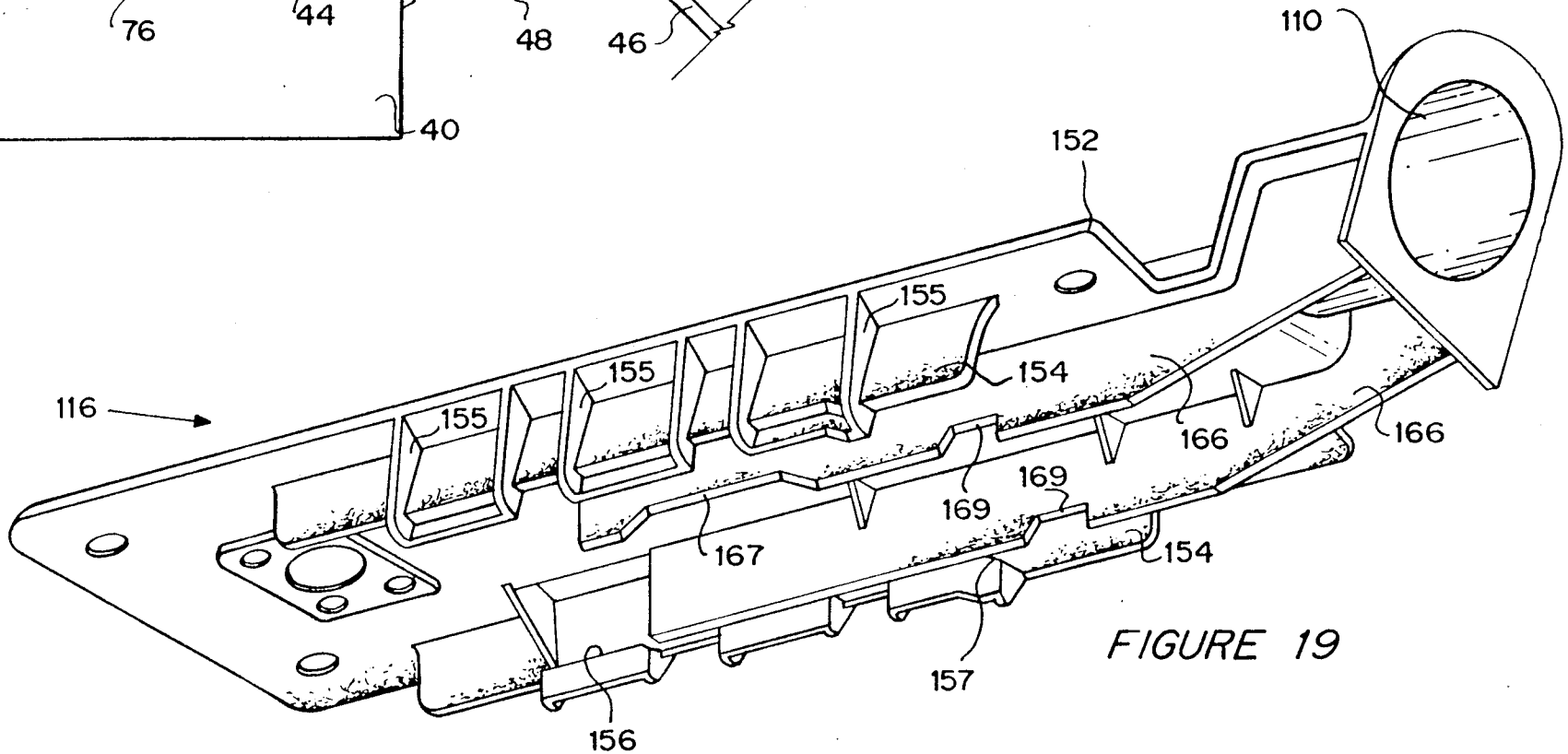
FIG. 19 is a bottom perspective view of the water supply valve housing.

Extending downward from plate 152 of valve housing 116 are guide members 154. (See FIG. 19.) Each guide member 154 includes a series of gussets 155 which stiffen and add strength to guide members 154. Between each pair of gussets 155 there extends a ledge 156 projecting from the inner face of guide members 154. When a disposable container 20 is inserted into a receptacle 18, guide members 154 serve to direct mounting bracket 40 therebetween such that flanges 44 reside on or above ledges 156. The lead portion of ledges 156 are downward for easier insertion of container 20. When disposable container 20 is fully and properly inserted into a receptacle 18 such that inlet nozzle 50 sealingly engages water supply line 158, key 68 will have moved to a position to engage lever 148 driving it upward thereby rotating pivot bar 140 upward and releasing locking bar 138 from notches 136.

Thus, when push button actuator 26 is pressed inward, spring 124 is compressed and the force is transmitted through rod 106 and spring 132 to thereby move magnet 134 and magnet bracket 118 into close proximity with solenoid valve 146. As push button actuator 26 is released spring 124 drives rod 106, magnet 134 and magnet bracket 118 to their original position and spring 141 urges pivot bar 140 to rotate downward such that locking bar 138 reoccupies notches 136. If a disposable container 20 has not been fully and properly inserted into receptacle 18 such that inlet nozzle 50 has failed to sealingly couple with water valve 27 key 68 will not have engaged lever 148. Locking bar 138 will still reside in notches 136 and pressure on push button actuator 26 will result in the compression of springs 124 and 13 while locking bar 138 holds magnet and magnet bracket 118 in their original positions.

Figure 20:
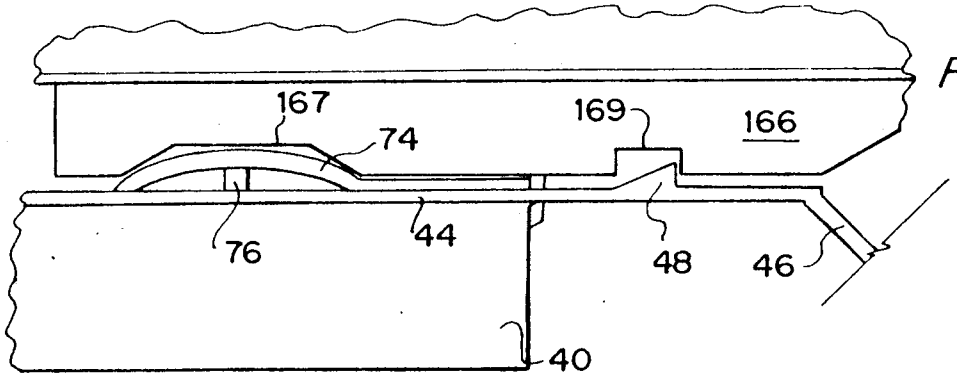
FIG. 20 is a detail partial side view of the flex member and ramps in relation to the plate members extending downward from the water supply valve housing.

When a refill module 20 is inserted into a compartment 18. Handle 46 must be deflected slightly downward to allow ramps 48 to pass by arms 166. Once ramps 48 move past arms 166, handle 46 springs upward such that ramps 48 engage the back side of arms 166 thereby locking refill module 20 in place. (See FIG. 20.) In order to remove a refill module 20 from a compartment 18, handle 46 must be depressed and pulled simultaneously to allow ramps 48 to get past arms 166. Ridges 48 thus lock a refill module 20 within a compartment 18 and ensure that water pressure through venturi housing 22 will not cause venturi housing 20 to separate from water valve supply housing 24 breaking the sealed engagement therebetween.

To prevent refill module 20 from leaking during shipping, refill module 20 is sent with shipping plug 162 inserted through dispensing tube 28 and venturi tube 80. Shipping plug 162 includes a series of annular projections 164 extending therefrom which engage the internal walls of venturi 80 downstream of orifice 92 and diameter which presses sealingly into throat 90. Shipping plug 162 contains any chemical concentrates which may flow from container 42 through draw tube 102, draw tube nozzle 100 and orifice 92 into venturi tube 80 during shipping thus preventing chemical concentrates from spilling out of refill module 20. Because container 42 is substantially rigid and will not collapse as concentrate is taken therefrom, a vent hole must be provided through threaded cap 59 the plastic or foil seal over spout 60. Failure to provide a vent hole would result in the attempt to pull a vacuum on container 42 when operating the venturi arrangement of the present invention. This vent hole is provided automatically upon insertion of the refill module 20 into a receptacle 18. Extending down from plate 152 are plate members 166. As mounting bracket 40 is moved into position such that flanges 44 slide in above ledges 156 and between guide members 154, one of the plate members 166 passes between venturi shell 52 and guide bar 66 thereby engaging and depressing flex member 74. The downward movement of flex member 74 drives vent probe 76 downward into and through recess 168 in threaded cap 59. Recess 168 is actually a thin area of limited structural integrity in cap 59 and intrusion by vent probe 76 punctures or ruptures that thin area. As refill module 20 is fully inserted into compartment 18, flex member 74 moves along arm 166 and reaches recess 167 which allows flex member 74 to resume its original shape thereby retracting vent probe 76 from the hole just created in the seal over spout 60. It can thus be seen that flex member 74 is, essentially, a leaf spring. Each plate member 166 includes a notch 169. As a refill module 20 is properly inserted into a compartment 18 ramps 48 contact plate members 166 causing handle to depress. When the refill module 20 is fully inserted, handle 46 springs upward with ramps 48 residing in notches 169 thereby locking refill module 20 within compartment 18. In order to remove refill module 20 from compartment 18, handle must be depressed far enough so that ramps 48 no longer reside within notches 169.

There are a series of rectangular ports 170 through plate 152 of frame 116. Ports 170 perform no function in the operation of water supply valve assembly 24. Ports 170 are necessary to mold frame 116, retainer 120, guide rail supports 126, tracks 127, upper guide rails 129 and 133, guide members 154, gussets 155, ledges 156 and plate members 166 into a single, integrally formed piece.

In operation, upon proper insertion of a refill module 20 into a compartment 18, solenoid valve 27 may be actuated by operation of push button actuator 26. In such manner, water is caused to flow through venturi tube 80. The resultant pressure drop taken across restriction throat 90 draws chemical concentrate from container 42, through indentation 105, foot 103, draw tube 102, port 171 in draw tube nozzle 101, cylindrical skirt 100, bore 172 in venturi shell 52 and orifice 92 to intermix in a predetermined ratio with the water flowing through venturi tube 80. As stated earlier herein, the predetermined ratio is set by the water pressure within venturi tube and the diameter of orifice 92.

It should be recognized that the bottle filling unit 12 can be used with or without the combination bottle/-bucket filling unit 14, or vice versa. Further, both the bottle filling unit 12 and the combination bottle/bucket filling unit 14 can be sized to have one or more compartments 18. Thus, a bottle filling unit 12 may be downsized from that depicted in the drawings such that it has a single compartment 18 for receipt of a single deposable container 20.

It should further be recognized that in order to perform precision dilution of chemical concentrates with a venturi, the water supply pressure must be known and it must be consistent. With the installation of each dilution station 10 of the present invention, it will therefore be necessary to measure the pressure of the water supply header, and, perhaps, install a pressure regulating device on the line from the water supply header to the dilution station.

From the foregoing, it will be seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A dilution station apparatus for diluting concentrates comprising:

(a) a frame having at least one compartment therein for insertion of a liquid holding container;

(b) a water valve housing connected to said frame and adapted to interface with a venturi housing including an unlocking means, said venturi housing affixed to said liquid holding container;

(c) valve means connected to said water valve housing;

(d) manual actuation means for opening and closing said valve means;

(e) locking means for preventing said valve means from being opened by said manual actuation means when said liquid holding container is not properly inserted into said compartment.

2. A dilution station apparatus as recited in claim 1 wherein said valve means is a solenoid valve.

3. A dilution station apparatus as recited in claim 2 wherein said manual actuation means includes:

(a) a piston supported within said frame;

(b) a rod extending from said piston;

(c) a magnet engagable with said rod, said piston and said rod operable to move said magnet into adjacent proximity with said solenoid valve.

4. A dilution station apparatus as recited in claim 1 further comprising:

(a) a funnelled female connector slidably affixed to said frame;

(b) a dispensing tube having a proximal end connected to said container and a distal end which is free, said funnelled female connector adapted to receive said distal end;

(c) a hose connected to said funnelled female connector.

5. A dilution station apparatus as recited in claim 1 wherein said manual actuation means comprises:

(a) piston means;

(b) a rod having a proximal end and a distal end, said proximal end connected to said piston means, said distal end having a spring retaining means affixed thereto;

(c) a retaining member projecting from said water valve housing;

(d) a spring positioned between said spring retaining means and said retaining member;

(e) a bracket means having a bore through a surface thereof, said surface of said bracket means being located between said spring and said spring retaining means;

(f) a magnet affixed to said bracket means.

6. A dilution station apparatus as recited in claims 5 wherein said locking means comprises:

(a) a pivot bar pivotally connected to said water valve housing;

(b) a locking bar extending from said pivot bar, said locking bar adapted to be received in at least one notch in said bracket means.

7. A dilution station apparatus as recited in claim 1 wherein said venturi housing comprises:

(a) an inlet nozzle;

(b) a venturi shell connected to said inlet nozzle;

(c) a discharge nozzle connected to said venturi shell.

8. A dilution station apparatus as recited in claim 7 wherein said venturi shell and said discharge nozzle are substantially cylindrical with a slight taper.

9. A dilution station apparatus as recited in claim 8 further comprising:

(a) a venturi tube contained within said venturi housing, said venturi tube having an inlet end and an outlet end, said outlet end sealingly engaging said discharge nozzle;

(b) an annular member radially extending from said venturi housing for sealingly engaging said venturi shell.

10. A dilution station apparatus as recited in claim 9 wherein:

said outlet end of said venturi tube is slightly tapered.

11. A dilution station as recited in claim 10 wherein the degree of taper of said outlet end of said venturi tube differs from the degree of taper of said discharge nozzle.

12. A refill for use with a dilution station for diluting chemical concentrates, the dilution station having at least one manually actuated valve, said refill comprising:

(a) a container;

(b) a venturi housing connected to said container;

(c) unlocking means extending from said venturi housing for unlocking said manually actuated valve when said refill is properly installed in the dilution station.

13. A refill for use with a dilution station as recited in claim 12 further comprising:

(a) a venturi tube within said venturi housing, said venturi tube having an inlet end and an outlet end;

(b) a draw tube connected to said venturi tube and extending into said container, said inlet end of said venturi tube connecting to said manually actuated valve when said refill is inserted into the dilution station.

14. A refill for use with a dilution station as recited in claim 13 further comprising:

a dispensing tube affixed to said outlet end of said venturi tube, said dispensing tube being substantially cylindrical in shape with a flat surface on that side of said dispensing tube nearest said container.

15. A disposable refill module for use with a dilution station having a water valve housing with a solenoid valve and manual actuation means for operating the solenoid valve, said disposable refill comprising:

(a) a container;

(b) a venturi housing connected to said container;

(c) a venturi tube contained within said venturi housing;

(d) key means extending from said venturi housing for unlocking the manual actuation means when said refill module is fully inserted into the dilution station.

16. A disposable refill module for use with a dilution station as recited in claim 15 further comprising:

(a) a handle affixed to said venturi housing;

(b) a ramp extending up from said handle for locking said refill module in the dilution station.

17. A disposable refill for use with a dilution station apparatus, the dilution station apparatus having at least one valve with manual actuation means connected thereto, said disposable refill comprising:

(a) a container;

(b) a venturi housing integrally formed with a mounting bracket for mounting said venturi housing to said container;

(c) a venturi tube affixed within said venturi housing by means of a plurality of struts extending from said venturi tube, each of said struts engaging a port in said venturi housing.

18. A disposable refill for use with a dilution station apparatus as recited in claim 17 further comprising:

unlocking means extending from said venturi housing for unlocking said manual actuation means when said disposable refill is fully inserted into the dilution station apparatus.

* * * * *